US008382243B2

(12) United States Patent
Miller et al.

(10) Patent No.: US 8,382,243 B2
(45) Date of Patent: Feb. 26, 2013

(54) PRINTER WITH REDUCED VORTEX OSCILLATION IN PRINT GAP

(75) Inventors: Jeffrey John Miller, Balmain (AU); Paul Justin Reichl, Balmain (AU); Samuel James Myers, Balmain (AU); Glenn David Horrocks, Balmain (AU); Aidan Patrick O'Mahony, Balmain (AU); Samuel George Mallinson, Balmain (AU)

(73) Assignee: Zamtec Ltd., Dublin (IE)

( * ) Notice: Subject to any disclaimer, the term of this patent is extended or adjusted under 35 U.S.C. 154(b) by 68 days.

(21) Appl. No.: 12/955,840

(22) Filed: Nov. 29, 2010

(65) Prior Publication Data

US 2012/0133708 A1 May 31, 2012

(51) Int. Cl.
*B41J 2/215* (2006.01)

(52) U.S. Cl. ..... 347/37; 347/34

(58) Field of Classification Search ..... 347/37
See application file for complete search history.

(56) References Cited

U.S. PATENT DOCUMENTS

| | | | | |
|---|---|---|---|---|
| 5,287,123 | A * | 2/1994 | Medin et al. | 347/17 |
| 5,564,847 | A * | 10/1996 | Patrick et al. | 400/642 |
| 6,886,905 | B2 | 5/2005 | McElfresh et al. | |
| 6,960,036 | B1 * | 11/2005 | Fujita et al. | 400/124.11 |
| 7,566,111 | B2 * | 7/2009 | Silverbrook et al. | 347/47 |
| 2009/0085960 | A1 * | 4/2009 | Yahiro et al. | 347/21 |

FOREIGN PATENT DOCUMENTS

| | | |
|---|---|---|
| JP | 56-038268 A | 4/1981 |
| JP | 63-064753 | 3/1988 |
| SU | 1147928 A | 3/1985 |

* cited by examiner

*Primary Examiner* — Matthew Luu
*Assistant Examiner* — Alexander D Shenderov
(74) *Attorney, Agent, or Firm* — Cooley LLP

(57) ABSTRACT

An inkjet printer that has a printhead with a nozzle array for ejecting droplets of ink onto a media substrate, a media feed assembly for feeding media passed the printhead in a media feed direction such that the nozzle array and the media substrate are separated by a print gap and, an air flow generation mechanism for generating an air flow in the print gap opposite to the media feed direction.

15 Claims, 4 Drawing Sheets

PRINTER WITH REDUCED VORTEX OSCILLATION IN PRINT GAP

FIELD OF THE INVENTION

The present invention relates to inkjet printing and in particular to pagewidth inkjet printers.

CROSS REFERENCES TO RELATED APPLICATIONS

Various methods, systems and apparatus relating to the present invention are disclosed in the following US patents/patent applications filed by the applicant or assignee of the present invention:

| | | | | |
|---|---|---|---|---|
| 7,744,195 | 7,645,026 | 7,322,681 | 7,708,387 | 7,753,496 |
| 7,712,884 | 7,510,267 | 7,465,041 | 11/246,712 | 7,465,032 |
| 7,401,890 | 7,401,910 | 7,470,010 | 7,735,971 | 7,431,432 |
| 7,465,037 | 7,445,317 | 7,549,735 | 7,597,425 | 7,661,800 |
| 7,712,869 | 7,712,876 | 7,712,859 | 7,794,061 | 7,845,765 |
| 7,798,603 | 7,784,902 | 7,775,630 | 7,824,010 | 7,841,695 |
| 7,841,697 | 11/946,838 | 11/946,837 | 7,597,431 | 12/141,034 |
| 12/140,265 | 12/183,003 | 12/196,280 | 12/206,743 | 12/264,839 |
| 12/265,724 | 7,794,060 | 7,784,912 | 12/391,962 | 12/436,137 |
| 12/436,139 | 12/559,346 | 12/702,122 | 12/772,848 | 12/773,710 |
| 12/773,741 | 12/773,695 | 12/773,626 | 12/786,318 | 12/817,169 |
| 12/832,991 | 12/904,986 | 12/909,748 | 12/909,754 | |

The disclosures of these applications and patents are incorporated herein by reference.

BACKGROUND OF THE INVENTION

Inkjet printing is a versatile and widely used form of print imaging. So called 'drop-on-demand' inkjet printing (as opposed to continuous inkjet printing) is the ejection of ink drops by forming vapor bubbles in a bubble forming liquid. This principle is generally described in U.S. Pat. No. 3,747,120 (Stemme). Each pixel in the printed image is derived ink drops ejected from one or more ink nozzles. Many different aspects and techniques for inkjet printing are described in detail in the above cross referenced documents.

Inkjet printers have a printhead with an array of nozzles though which ink is ejected onto a media substrate such as paper or film. Typical SOHO (Small Office, Home Office) inkjet printers or wide format inkjet printers have a scanning printhead. The printhead scans across the printed width of the media substrate and prints a swathe of the printed image with each traverse.

More recently, pagewidth printers have been developed to speed up the printing process. A pagewidth printhead remains stationary within the printer and has an array of nozzles that extends the entire printing width of the media substrate. Media substrate passes through the printer as the printhead prints the width of the media simultaneously. By not traversing the printhead across the media as it indexes through the printer, print speeds are significantly increased.

The gap between the nozzle array and the surface of the media substrate is referred to as the 'print gap' or the printhead to paper separation (PPS). This gap is typically less than 3 mm. However, the movement of the media substrate and the ejection of ink drops can generate vortices in the air flow through the print gap. Under certain conditions, the vortices in the air flow oscillate and skew the trajectories of the ejected ink drops. This produces visible artifacts in the printed image and degrades print quality. The artifacts appear as a series of irregular bands extending generally transverse to the media feed direction and are generally referred to as 'tiger stripes', 'sand dunes', 'wood grain' or 'worms'.

SUMMARY OF THE INVENTION

Accordingly, the present invention provides an inkjet printer comprising:

a printhead with a nozzle array for ejecting droplets of ink onto a media substrate;

a media feed assembly for feeding media past the printhead in a media feed direction such that the nozzle array and the media substrate are separated by a print gap; and, an air flow generation mechanism for generating air flow in the print gap opposite to the media feed direction.

The Applicants analysis of 'tiger striping' has found that generating air flow in the print gap counter to the air flow caused by media movement will remove or substantially reduce the oscillation of the vortices. Without the oscillation of the vortices, the printed image does not suffer from tiger stripes.

Preferably, the printhead is a pagewidth printhead and the nozzle array extends a printing width of the media substrate. Preferably, the air flow generation mechanism is operatively linked to the media feed assembly. Preferably, the air flow generation mechanism has a roller positioned adjacent the pagewidth printhead, the roller having an axis of rotation extending parallel to the printing width of the media substrate and perpendicular to the media feed direction. Preferably, the roller is part of the media feed assembly. Preferably, the print gap is more than 1 mm. Preferably, the print gap is between 1 mm and 2 mm.

Preferably, the pagewidth printhead is configured to eject droplets of ink with a volume less than 3 pico-liters. Preferably, the pagewidth printhead is configured to eject droplets of ink with a volume less than 2 pico-liters. Preferably, the pagewidth printhead is configured to eject droplets of ink with a volume between 1.0 pico-liters and 2.0 pico-liters.

Preferably, the media feed assembly feeds media past the pagewidth printhead at more than 0.15 msec. Preferably, the media feed assembly feeds media past the pagewidth printhead at more than 0.3 msec. Preferably, the media feed assembly feeds the media past the printhead at more than 0.5 msec.

Preferably, the pagewidth printhead has a series elongate printhead integrated circuits mounted end to end such that they extend the printing width of the media substrate, each of the printhead integrated circuits having a portion of the nozzle array. Preferably, the nozzle array has nozzles arranged in rows extending the printing width of the media substrate, and perpendicular to the media feed direction. Preferably, each of the printhead integrated circuits is configured to simultaneously eject at least three different colors of ink.

Preferably, the roller axis is less than 30 mm from the printhead integrated circuits. In a further preferred form, the roller has a diameter less than 10 mm.

BRIEF DESCRIPTION OF THE DRAWINGS

Preferred embodiments of the present invention will now be described by way of example only with reference to the accompanying drawings, in which.

DETAILED DESCRIPTION OF THE PREFERRED EMBODIMENTS

Figure 1:
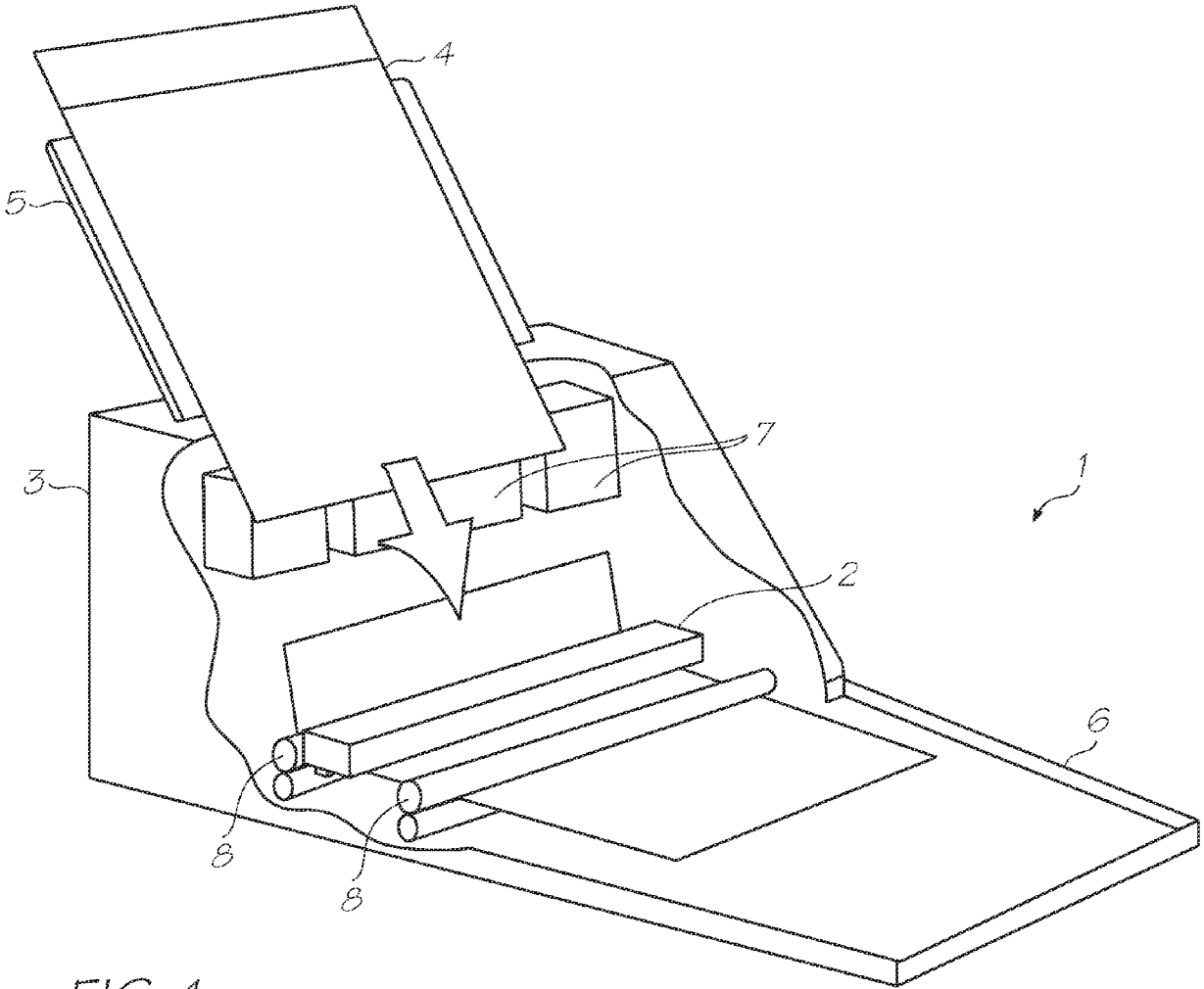
FIG. 1 is a schematic perspective of a printer partially cutaway to reveal the pagewidth printhead.

Referring to FIG. 1, the inkjet printer 1 is shown partially cut away to reveal the pagewidth printhead 2 within the outer casing 3. Sheets of media substrate 4 (common paper) are fed from the media feed tray 5, past the printhead 2, to the media collection tray 6. Ink stored in cartridges 7 is fed to the printhead 2 for ejection onto the media substrate 4 while it is continuously moved along a feed path by the media feed assembly 8.

Figure 2:
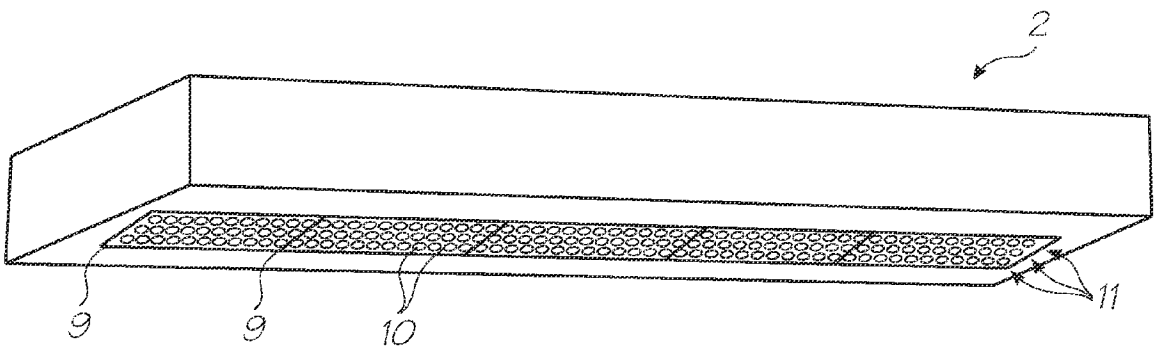
FIG. 2 PRIOR ART
FIG. 2 is a schematic perspective of the pagewidth printhead in isolation.

As shown in FIG. 2, the printhead 2 is a pagewidth printhead where the nozzle array 10 extends the entire printing width of the printer. The nozzle array 10 is formed by five elongate printhead integrated circuits (ICs) 9 arranged end to end. Each of the printhead ICs 9 prints ink from all the cartridges 7. The nozzles array 10 is arranged into nozzle rows 11 extending transverse to the media feed direction (see FIGS. 3 and 5). Each row 11 is dedicated to one color and each color supplies at least one row 11 in the nozzle array 10. The media substrate 4 (FIG. 1) is not indexed slowly past the printhead as it is with scanning printhead printers. Accordingly, media feed speeds are substantially increased which permits much higher print speeds.

Figure 3:
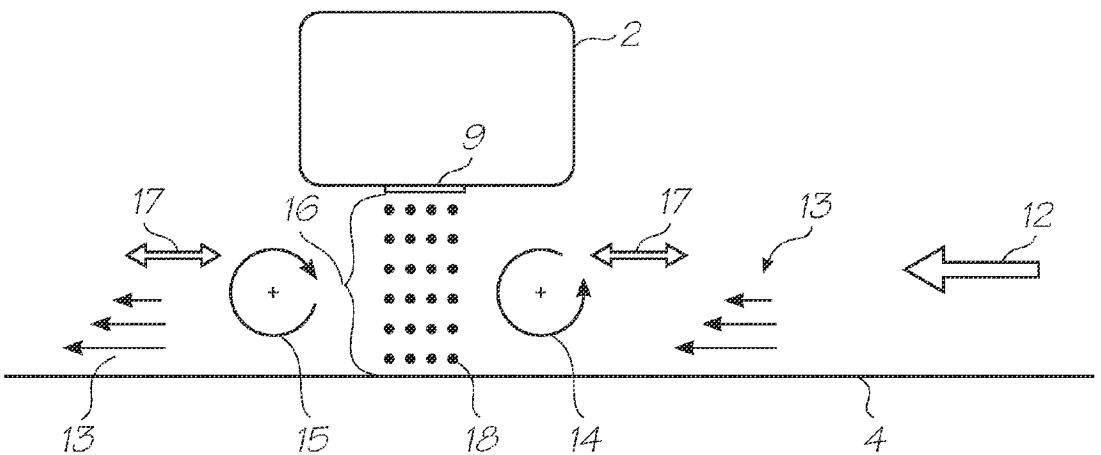
FIG. 3 PRIOR ART
FIG. 3 is a schematic section view of the printhead and media substrate with oscillating vortices in the print gap.
Figure 4:
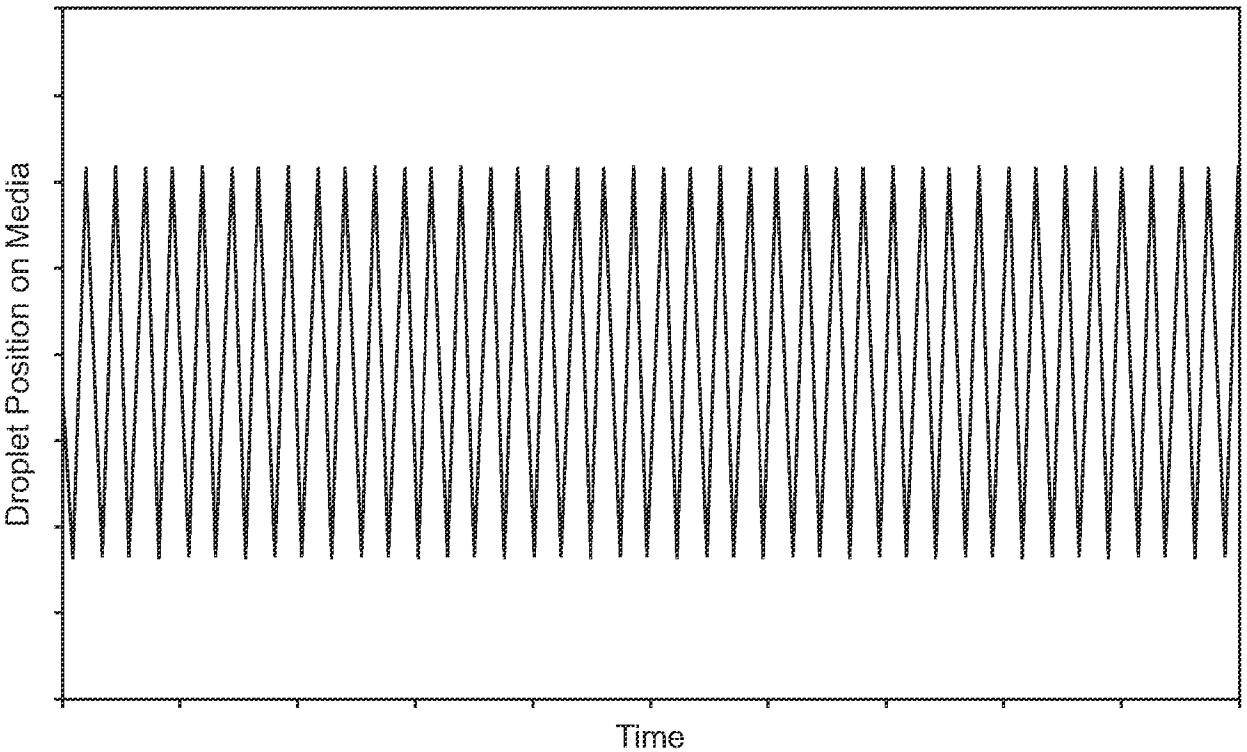
FIG. 4 PRIOR ART
FIG. 4 is a graph showing the deflection of ink oscillation of droplet position on media substrate over tie; and, FIG. 5 is a schematic section view of the printhead and media substrate with additional airflow generated by upstream paper roller.

FIG. 3 is a schematic section view of the printhead 2 printing ink droplets 18 onto a sheet media substrate 4 moving along a media feed direction 12. The space between the printhead ICs 9 and the media substrate 4 is referred to as the print gap 16. The fast moving media substrate 4 creates an air flow 13 through the print gap 16. This air flow interacts with the ejection of ink droplets 18 to form an upstream vortex 14, immediately upstream of the droplets 18, and a downstream vortex 15 immediately downstream of the droplets 18. Under certain conditions the vortices 14 and 15 can oscillate 17 and cause misdirection of the ink droplets 18. A typical response of droplet placement over time is shown in FIG. 4.

Figure 5:
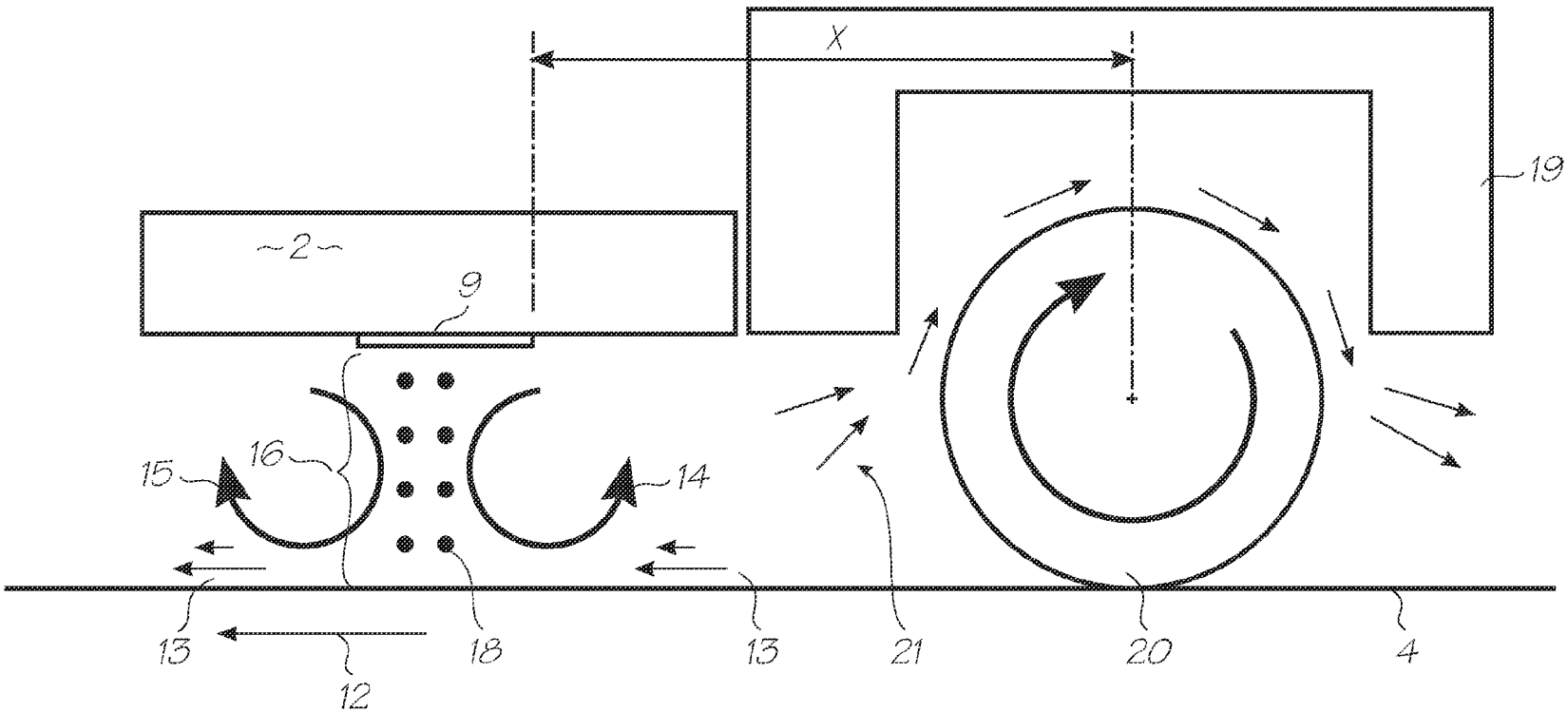

As shown in FIG. 5, the oscillation of the vortices 14 and 15 has been removed or substantially reduced by using a paper feed roller 20 as an air flow generator to generate an additional air flow 21 opposing the media feed direction 12. The additional air flow 21 is counter to the air flow 13 caused by movement of the media substrate 4. Increasing the media feed speed (if, for example the printer is set to print in a faster draft resolution mode) increases the air flow 13 generated by the media substrate movement but also increases the air flow 21 generated by the roller 20 to keep the vortices 14 and 15 in the print gap 16 stable, The roller 20 should be relatively proximate the printhead ICs 9 to generate adequate air flow 21 in the print gap 16. The Applicant's testing has found that for roller diameters less than 10 mm, and media feed speeds of more than 0.15 m/sec, the spacing X from the roller axis to the printhead ICs 9 should be less than 30 mm. Furthermore, any sources of pressure loss between the printhead ICs 9 and the roller 20 should be avoided. Using a shroud or roller cover 19 ensures the air flow 21 is largely drawn from the print gap 16.

The size of the droplets 18 has a bearing on the amount of tiger striping in the printed image. Larger volume droplets, say more than 4 pico-liters, suffer less misdirection from oscillation of the vortices than smaller droplets and so result in less tiger striping. However, large drops result in large dots on the paper and this compromises spatial resolution and colour resolution. Drops of around 2 pl are required to decrease image "graininess" below the limit of resolution of the human eye. Applicant testing in this area has found that the present invention allows the droplet volume to be less than 3 pico-liters. More importantly from an image quality perspective, droplet volumes less than 2 pico-liters do not generate visible tiger striping. Applicant's development in this area has found droplet volumes between 1 pico-liter and 2 pico-liters are desirable for optimum print quality. Test prints with droplet volumes in this range are also free of tiger striping.

Although the vortices 14 and 15 and their oscillation 17 is reduced with smaller print gaps 16 and eliminated entirely by reducing the print gap 16 to <~1 mm, this makes media handling more challenging. There are several compelling reasons to increase the print gap 16:

a) In typical double-sided/duplex printing, the paper is not printed on both sides simultaneously. During half-duplex printing (where the page is printed on one side and then passed under the same printhead a second time to print on the reverse side), the first side of the paper will be wet with ink, and the paper will no longer be flat. The term 'cockle' is often used to describe this. A larger print gap accommodates the cockle in the paper, without risk of the paper striking the printhead IC's 9.

b) Simplex (single-sided) or duplex printing of media substrate with an uneven surface (eg corrugated board or envelopes) also requires a larger print gap 16.

c) The ability to print on different thickness media is another common user expectation. Although this can be achieved through more sophisticated paper handling systems, a larger print gap will enable this with a less complex and lower cost media feed assembly 8. Indeed, regardless of different media thicknesses, increased print gaps potentially allow a cost reduction in the paper handling system through use of lower specification components and assembly.

Using the present invention, the print gap 16 can be greater than 1 mm while the additional air flow 21 suppresses oscillations in the upstream and down stream vortices 14 and 15. Testing has found that the invention permits a print gap 16 between 1 mm and 2 mm without visible tiger stripes in the resulting print.

The invention has been described herein by way of example only. Skilled workers in this field will readily appreciate that many variations and modifications are possible without departing from the spirit and scope of the broad inventive concept.

The invention claimed is:

1. An inkjet printer comprising:

a pagewidth printhead with a nozzle array for ejecting droplets of ink onto a media substrate;

a media feed assembly for feeding media continually passed the pagewidth printhead in a media feed direction such that the nozzle array and the media substrate are separated by a print gap; and, an air flow generation mechanism for generating an air flow in the print gap opposite to the media feed direction, wherein the air flow generation mechanism comprises:

a roller positioned adjacent and upstream of the pagewidth printhead such that the media is fed in a linear fashion from the roller to the pagewidth printhead, the roller having an axis of rotation extending parallel to the printing width of the media substrate and perpendicular to the media feed direction; and a shroud covering the roller for drawing air flow from the print gap.

2. The inkjet printer according to claim 1 wherein the roller is part of the media feed assembly.

3. The inkjet printer according to claim 1 wherein the print gap is more than 1 mm.

4. The inkjet printer according to claim 1 wherein the print gap is between 1 mm and 2 mm.

5. The inkjet printer according to claim 1 wherein the pagewidth printhead is configured to eject droplets of ink with a volume less than 3 pico-liters.

6. The inkjet printer according to claim 1 wherein the pagewidth printhead is configured to eject droplets of ink with a volume less than 2 pico-liters.

7. The inkjet printer according to claim 1 wherein the pagewidth printhead is configured to eject droplets of ink with a volume between 1.0 pico-liter and 2.0 pico-liters.

8. The inkjet printer according to claim 1 wherein the media feed assembly feeds media past the pagewidth printhead at more than 0.15 m/sec.

9. The inkjet printer according to claim 1 wherein the media feed assembly feeds media past the pagewidth printhead at more than 0.3 m/sec.

10. The inkjet printer according to claim 1 wherein the media feed assembly feeds the media past the printhead at more than 0.5 m/sec.

11. The inkjet printer according to claim 1 wherein the pagewidth printhead has a series of elongated printhead integrated circuits mounted end to end such that they extend the printing width of the media substrate, each of the printhead integrated circuits having a portion of the nozzle array.

12. The inkjet printer according to claim 11 wherein the nozzle array has nozzles arranged in rows extending the printing width of the media substrate, and perpendicular to the media feed direction.

13. The inkjet printer according to claim 11 wherein each of the printhead integrated circuits is configured to simultaneously eject at least three different colors of ink.

14. The inkjet printer according to claim 1 wherein the roller axis is less than 30 mm from the printhead integrated circuits.

15. The inkjet printer according to claim 14 wherein the roller has a diameter less than 10 mm.

* * * * *